US006085684A

United States Patent [19]

Cotton

[11] Patent Number: 6,085,684

[45] Date of Patent: Jul. 11, 2000

[54] TRIM TAB ACTUATOR FOR POWER BOATS

[76] Inventor: R. Gene Cotton, P.O. Box 12475, Alexandria, La. 71315

[21] Appl. No.: 09/021,364

[22] Filed: Feb. 11, 1998

[51] Int. Cl.[7] ..... B63B 1/22

[52] U.S. Cl. ..... 114/285; 440/1; 440/84

[58] Field of Search ..... 440/1, 84, 85, 440/86, 87; 114/285, 286, 287

[56] References Cited

U.S. PATENT DOCUMENTS

| | | | |
|---|---|---|---|
| 3,140,689 | 7/1964 | Miner . | |
| 3,141,351 | 7/1964 | Behan | 74/484 |
| 4,801,282 | 1/1989 | Ogawa et al. | 440/84 |
| 4,898,563 | 2/1990 | Torigai et al. | 440/1 |
| 4,962,717 | 10/1990 | Tsumiyama | 114/144 R |
| 4,976,636 | 12/1990 | Torigai et al. | 440/1 |
| 5,242,320 | 9/1993 | Schmidt et al. | 440/86 |

OTHER PUBLICATIONS

Gaffrig Precision Instruments by Livorsi Marine Inc., Throttles & Controls, p. 7.

*Primary Examiner*—Jesus D. Sotelo

*Attorney, Agent, or Firm*—Garney, Smith, Nehrbass & Doody, LLC

[57] ABSTRACT

A trim tab control apparatus includes a switch housing that mounts to the lever of a throttle of a boat. The switch housing provides a socket that holds a dual trim tab switch arrangement in front of and below the handle of the throttle. This enables a pilot of a boat to operate either or both of the switches that control the port and starboard trim tabs. The pilot of the boat can operate either trim tab by depressing a selected of the switches or both trim tabs can be raised or lowered at the same time by operating both switches at the same time with one finger, wherein typically only the index finger of the pilot is required. The apparatus of the invention enables the operator of a boat to operate both port and starboard trim tabs without even having to view the switches because they are in such close proximity to the user's index finger while the pilot is driving the boat, holding onto the throttle.

16 Claims, 2 Drawing Sheets

TRIM TAB ACTUATOR FOR POWER BOATS

BACKGROUND OF THE INVENTION

1. Field of the Invention

The present invention relates to marine power boats, more particularly trim tab controllers for raising and lowering the trim tabs on such power boats. Even more particularly, the present invention relates to an improved trim tab actuator for power boats that is ergonomically superior to the prior art by providing a trim tab switch arrangement that can include two switches for operating either or both port and starboard trim tabs at a position immediately in front of and below the throttle handle so that a user can depress either trim tab operator switch (or both switches) simultaneously with a single finger of the user's hand (preferably the index finger) and at the same time that the user operates the boat with the throttle lever.

2. General Background of the Invention

Many marine vessels are provided with trim tabs that can be used to adjust the attitude of the boat while underway and on plane. Trim tabs are commonly used on boats in the range of about eighteen to fifty feet (181–501) for example. Such trim tabs are used on the common recreational power boat that is provided with either one or two outboard motors or inboard/outboard type drives or inboard drives.

One very common arrangement is to provide a deep V-type hull with two outboard or inboard/outboard engines and with port and starboard trim tabs. Trim tabs are especially important when operating a boat in heavy seas or for trimming a boat when the weight shifts dramatically, such as when passengers on the boat move from the port side to the starboard side for example.

One of the most common trim tab arrangements uses hydraulic motors to power cylinders that extend and retrack so as to lift and lower the trim tabs during use. Such hydraulic trim tabs are commercially available under the name of "Kiekhaefer" and "Bennett", as examples.

One of the problems with trim tabs is the operation of such devices when the boat is underway at high speed and/or in rough seas. In such a case, it is very difficult for the pilot of the boat to use his or her hands for anything other than holding on to the steering wheel and the throttle lever. Many trim tab actuators are mounted on the dashboard of the boat at a position away from the throttle. This requires the pilot of the boat to remove his or her hand from the throttle lever in order to manipulate the trim tab actuators on the dashboard. The pilot must visually search for such trim tab operator switches while attempting to maintain control of a boat that might be travelling at speeds of 50 - even 110 miles per hour.

This creates a hazard to the boat, its pilot, and occupants because the pilot of the boat must view the dashboard of the boat to control the trim tabs rather than focus on the sea in front of the boat.

BRIEF SUMMARY OF THE INVENTION

The present invention provides a trim tab apparatus for controlling the trim tabs of a motor boat or power boat from one of the boat throttle levers used to control its outboard motor, inboard/outboard, or like propulsion unit.

With the apparatus of the present invention, switch members are provided in front of the throttle lever in a position that enables the pilot of the boat to operate either or both of the switch members with the index finger of the user's hand and without having to release the user's hand from the handle of the throttle lever.

The apparatus of the present invention thus provides an improved trim tab control device for controlling the trim tabs of a power boat.

The apparatus of the present invention is in the form of a support bracket that is attached to the throttle lever of the power boat. The throttle lever is commonly used to control the boat's outboard motor, inboard/outboard, inboard or like propulsion unit.

For twin engine installations, the power boat has a pair of outboards or like propulsion units. For twin engine installations, two throttle levers are provided. The present invention enables the support housing to be attached to either of the selected throttle levers of a twin engine installation while still enabling the pilot of the boat to operate both trim tabs with a single finger of the hand that is used to operate the throttle levers.

The present invention provides safety and utility to the pilot of a boat especially in high speed or rough seas conditions. The present invention enables the pilot of the boat to leave one hand on the steering wheel of the boat and the other handle on the throttle lever when operating the trim tabs. From this position, the pilot of the boat can operate either or both of the trim tabs without removing his or her hands from either the steering wheel or the throttle lever or levers.

The apparatus of the present invention includes a switch housing having port and starboard switch members that are mounted within a support bracket. Each switch member is movable between up, off, and down positions that can be used to either raise or lower the selected trim tab or affix the trim tab in a selected position.

The support bracket includes an arm that extends from the throttle lever forward to a position that places the switch housing in front of the throttle lever and preferably somewhat below the handle portion of the throttle lever. In this fashion, the user can operate either or both of the switch members with a single finger of the user's hand (e.g., index finger) while simultaneously gripping the throttle lever.

The switch members are preferably in the form of a pair of elongated rectangular switches that are generally parallel to one another. The switch members occupy a plane that intersects the throttle lever near an attachment of the handle to the stem of the throttle member.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
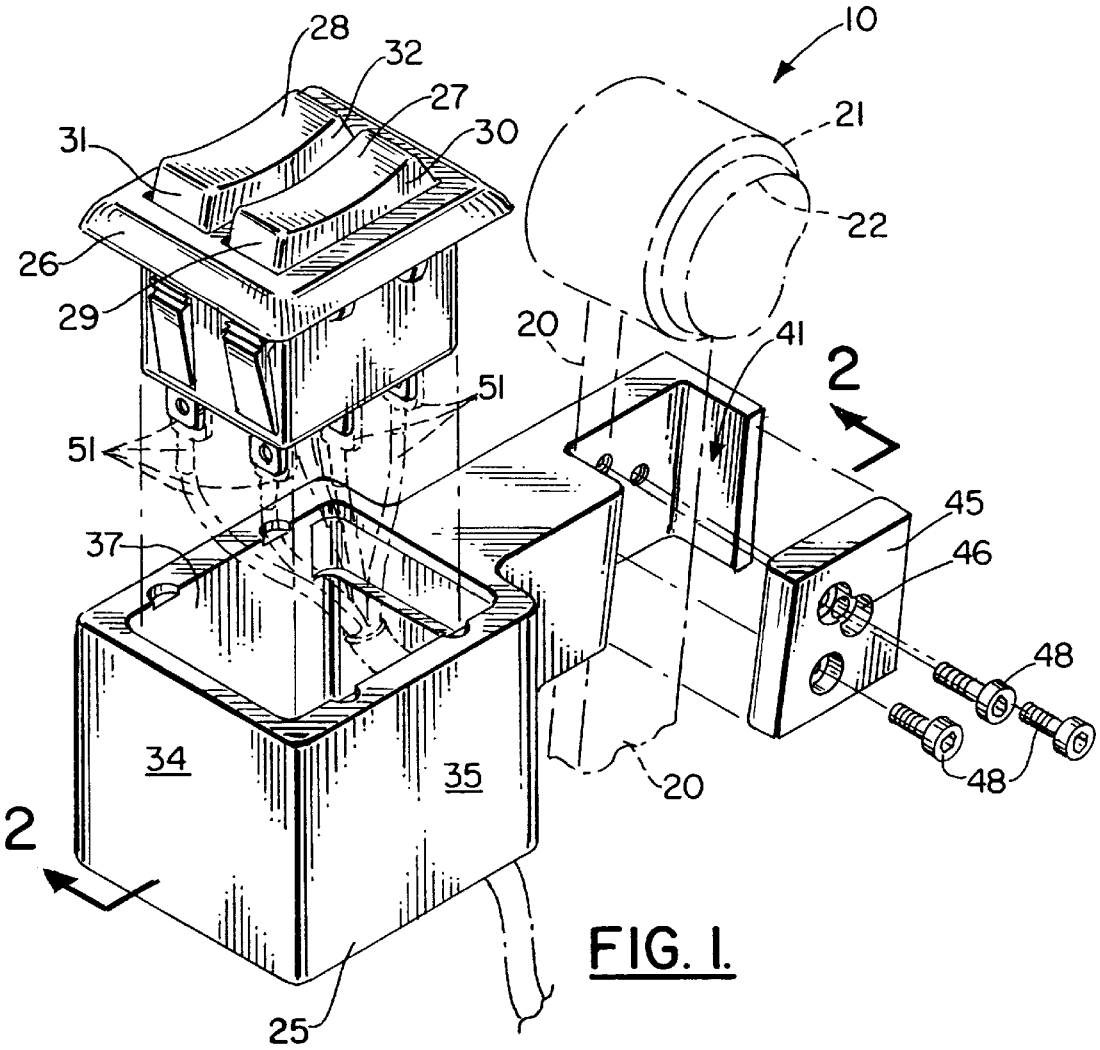
FIG. 1 is a perspective exploded view of the preferred embodiment of the apparatus of the present invention.
Figure 3:
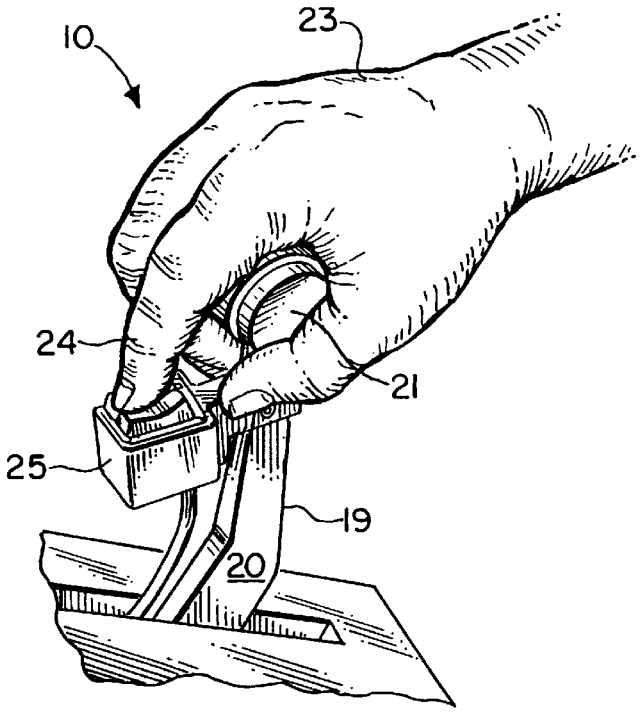
FIG. 3 is a perspective view of the preferred embodiment of the apparatus of the present invention.
Figure 4:
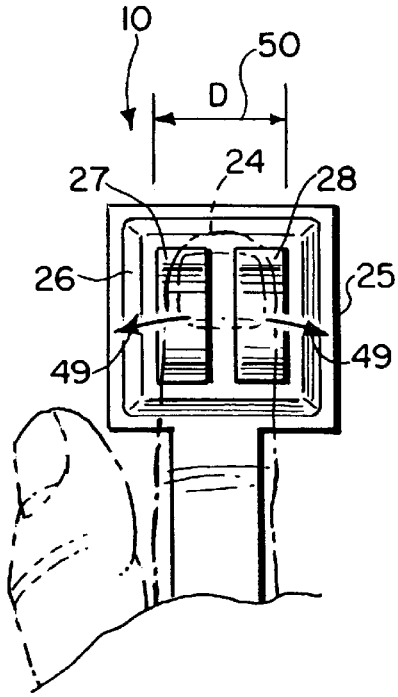
FIG. 4 is a partial top view of the preferred embodiment of the apparatus of the present invention.

FIGS. 1, 3, and 4 show generally the preferred embodiment of the apparatus of the present invention designated generally by the numeral 10 in FIGS. 1, 3, and 4. Trim tab controller apparatus 10 is preferably used for controlling the hydraulic trim tabs of a boat having a hull 11 with a transom 12. Typically, trim tabs are provided on deep V-type hulls which are commonly of fiberglass, wood, or metal construction, and which can range in length from about 18–50 feet or more.

Figure 5:
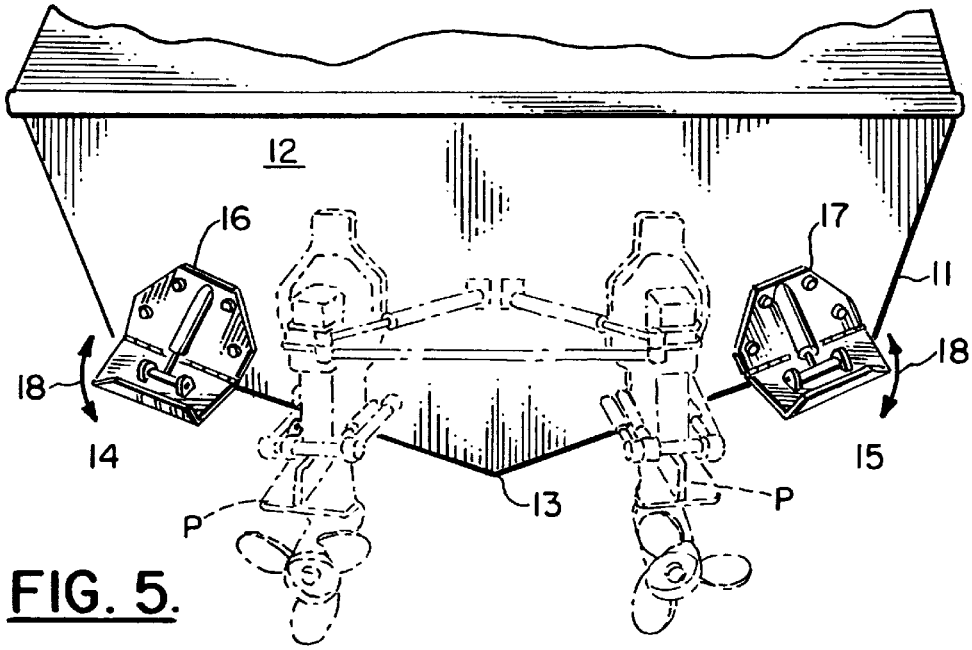
FIG. 5 is a perspective view of a typical trim tab arrangement on the transom of a boat hull.

In FIG. 5, such a boat hull 11 is shown having a transom 12 with keel 13 and a pair of propulsion units P (e.g., inboard/ outboard drives as shown, outboard drives or inboard drives) and a pair of opposed trim tabs 14, 15. The port trim tab 14 is operated with a hydraulic extensible cylinder 16. The starboard trim tab 15 is operated with a starboard cylinder 17. Arrows 18 in FIG. 5 indicates the upward and downward pivoting movement of the trim tabs. These trim tabs help maintain an orientation of the hull 11 relative to the water surface as selected by the boat's pilot.

In FIGS. 1-4, the trim tab controller apparatus 10 of the present apparatus of the present invention includes a switch housing 25 that is mounted to a throttle lever 19 of a boat's engine throttle. The throttle lever 19 of the boat typically includes a stem 20 having an uppermost handle 21 that can be round or cylindrically shaped for example. Such throttle levers are known in the art, being manufactured by Mercruiser, Keikhaefer, OMC, Yamaha, Mercury, and other manufacturers of marine propulsion units, outboard motors, inboard/outboard motors, and the like.

In FIGS. 1 and 5, the throttle lever 19 shown is commonly supplied with Mercruiser inboard/outboard propulsion units P such as those supplied on the Thunderbird Formula hulls that can be 25–40 feet in length, for example. Such a throttle lever 19 provides an engine trim button 22 that is used to raise and lower the out drive for an inboard/ outboard engine and to trim that outdrive.

Switch housing 25 includes a socket 33 that extends in front of and below handle 21 of throttle lever 19. This positioning of socket 33 is important because it determines the placement of switch assembly 26 that fits into socket 33 of switch housing 25 as shown in FIGS. 1–4. By so positioning the socket 33 of switch housing 25 and the switch assembly 26, a pilot can operate either the port switch 27 or starboard switch 28 of switch assembly 26 for raising either the port trim tab 14 or the starboard trim tab 15 or for lowering the selected trim tab 14, 15.

In FIGS. 3 and 4, a user's hand is designated by the numeral 23. The user's index finger 24 would typically be used to operate either of the port or starboard switches 27, 28 respectively during use. In keeping with the teaching of the present invention, the switches 27, 28 are spaced together so that a user's index finger 24 can operate the switches 27, 28 simultaneously as shown in FIG. 4 to either raise the trim tabs 14, 15 at the same time, or to lower the tim tabs 14, 15 at the same time.

In FIG. 4, arrows 49 indicate that the user's index finger 24 can be moved from port to starboard for operating either of the switches 27, 28 or from operating both of the switches 27, 28 at the same time. In that regard, the distance D in FIG. 4 indicated by the arrow 50 is the overall width of boat switches 27, 28 a distance that is preferably between about five-eighth inches (5/8") and seven-eighth inches (7/8") . The present invention thus provides a method and apparatus for controlling the trim tabs of a marine vessel with a single finger of the pilot's hand, either simultaneously, or one at a time.

Each of the trim tab switches 27, 28 provides a first end and a second end. The first end is used to raise the selected trim tab. The second end is used to lower the trim tab. In FIGS. 1 and 3–4, port switch 27 has a first end 29 and a second end 30. Starboard switch 28 has a first end 31 and a second end 32.

Figure 2:
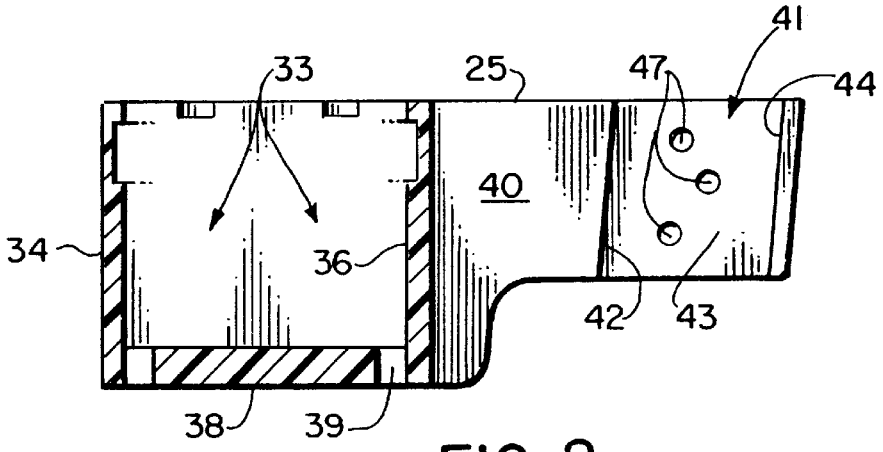
FIG. 2 is a sectional view taken along lines 2—2 of FIG. 1.

Switch housing 25 is comprised of a plurality of walls 34, 35, 36, 37 that are arranged in a square or rectangle as shown in FIGS. 1, 2, and 4. The walls 34, 35, 36, 37 in combination with bottom 38 surround and protect the terminals and electrical cables (designated generally in phantom lines by the numeral 51 in FIG. 1) from salt spray, rain water, and the like during use.

Switch housing 25 is mounted to the stem 20 of throttle lever 19 as shown in FIGS. 1 and 3. Switch housing 25 provides a horizontally extending arm 40 having a channel shaped portion 41. The channel shaped portion 41 receives stem 20 as shown in FIG. 1 so that the surfaces 42, 43, 44 engage the correspondingly shaped surfaces of stem 20.

Plate 45 is used to secure switch housing 25 to stem 20 by bolted connections, or like connectors, for example. Openings 46 in plate 45 receive bolts 48. Similarly positioned openings 47 in housing 25 receive bolts 48. The openings 47 can be internally threaded to form threaded connections with the bolts 48. Openings can be drilled from stem 20 through which bolts 48 pass. The throttle lever 19 provided with mercury inboard/outboard engines have slots through which bolted connections 48 can be passed.

PARTS LIST

| Part | Description |
|---|---|
| 10 | trim tab controller apparatus |
| 11 | hull |
| 12 | transom |
| 13 | keel |
| 14 | trim tab |
| 15 | trim tab |
| 16 | cylinder |
| 17 | cylinder |
| 18 | arrow |
| 19 | throttle lever |
| 20 | stem |
| 21 | handle |
| 22 | engine trim |
| 23 | user's hand |
| 24 | user's index finger |
| 25 | switch housing |
| 26 | switch assembly |
| 27 | port switch |
| 28 | starboard switch |
| 29 | first end |
| 30 | second end |
| 31 | first end |
| 32 | second end |
| 33 | socket |
| 34 | wall |
| 35 | wall |
| 36 | wall |
| 37 | wall |
| 38 | bottom |
| 39 | opening |
| 40 | arm |
| 41 | channel |
| 42 | surface |
| 43 | surface |
| 44 | surface |
| 45 | plate |
| 46 | opening |
| 47 | opening |
| 48 | bolt |
| 49 | arrow |
| 50 | arrow |
| 51 | terminal |

The foregoing embodiments are presented by way of example only; the scope of the present invention is to be limited only by the following claims.

I claim:

1. A trim tab control for controlling the trim tabs of a motor boat from one of the motor boat throttle levers, comprising:

a) a motor boat having a hull powered by one or more propulsion units and port and starboard trim tabs;

b) one or more throttle levers that control the propulsion units to power the boat to a selected speed;

c) each throttle lever having a stem with an upper end having a handle to be gripped by the hand of a user;

d) a support bracket positioned on the stem below the handle;

e) the support bracket including a switch housing having port and starboard switch members, each switch member movable between "up", "off", and "down" positions that raise, lower or affix the trim tab in a selected position; and f) wherein the switch housing is so configured that the user's finger extends generally in front of and below the handle in order to operate a selected switch member.

2. The trim tab control apparatus of claim 1 wherein a single finger of the user can simultaneously operate both switch members or a selected of the switch members.

3. The trim tab control apparatus of claim 1 wherein the support bracket includes an arm extending from the throttle lever forward to position the switch housing in front of the throttle lever.

4. The trim tab control apparatus of claim 3 wherein the switch members occupy a plane that intersects the throttle lever near an attachment of the handle to the stem.

5. The trim tab control apparatus of claim 1 wherein the switch members have a combined width of between five-eighth inches (5/8") and seven-eighth inches (7/8").

6. The trim tab control apparatus of claim 1 wherein the switch members are elongated members that are parallel.

7. The trim tab control apparatus of claim 1 wherein the switch members are each generally rectangular elongated members that are parallel.

8. The trim tab control apparatus of claim 1 wherein the support bracket includes an arm with one end portion that attaches to the stem below the handle and another end portion that supports the switch housing in front of the stem and wherein the switch members are positioned in front of the handle.

9. The trim tab control apparatus of claim 1 wherein the support bracket includes an arm with one end portion that attaches to the stem below the handle and another end portion that supports a walled receptacle having a socket that holds the switch housing in front of the stem and wherein the switch members are positioned in front of the handle.

10. A trim tab control for controlling trim tabs on a power boat having a hull, a propulsion unit and a throttle lever with a stem and a handle that controls the propulsion unit, comprising:

a) a support bracket positioned on the stem below the handle;

b) the support bracket including a switch housing having port and starboard switch members, each switch member movable between "up", "off", and "down" positions that raise, lower or affix the trim tab in a selected position;

c) wherein the switch housing is so configured that the user's finger extends generally in front of and below the handle in order to operate a selected switch member; and d) wherein the switch members are positioned in front of the handle and stem and facing upwardly so that a user can operate either or both of the switch members with a finger of the user's hand that simultaneously grips the handle.

11. The trim tab control apparatus of claim 10 wherein the switch members have a combined width of between five-eighth inches (5/8") and seven-eighth inches (7/8").

12. The trim tab control apparatus of claim 10 wherein the switch members are elongated members that are parallel.

13. The trim tab control apparatus of claim 10 wherein the switch members are each generally rectangular elongated members that are parallel.

14. The trim tab control apparatus of claim 10 wherein the support bracket includes an arm with one end portion that attaches to the stem below the handle and another end portion that supports the switch housing in front of the stem and wherein the switch members are positioned in front of the handle.

15. The trim tab control apparatus of claim 10 wherein the support bracket includes an arm with one end portion that attaches to the stem below the handle and another end portion that supports the a walled receptacle having a socket that holds the switch housing in front of the stem and wherein the switch members are positioned in front of the handle.

16. A trim tab control for controlling trim tabs on a power boat having a hull, a propulsion unit and a throttle lever with a stem and a handle that controls the propulsion unit, comprising:

a) a support bracket positioned on the stem below the handle;

b) the support bracket including a switch housing having port and starboard switch members, each switch member movable between "up", "off", and "down" positions that raise, lower or affix the trim tab in a selected position;

c) wherein the switch housing is so configured that the user's finger extends generally in front of and below the handle in order to operate a selected switch member; and d) wherein the switch members are positioned in front of the stem, and face upwardly so that the switch members are facing the user's fingers enabling a user to operate either or both of the switch members with a finger of the user's hand without having to release the user's hand from the handle.

* * * * *